US005915828A

United States Patent [19]

Buckley

[11] Patent Number: 5,915,828

[45] Date of Patent: Jun. 29, 1999

[54] MOTION PICTURE LIGHTING FIXTURE

[76] Inventor: John Buckley, P.O. Box 2761, Oakhurst, Calif. 93644

[21] Appl. No.: 08/794,330

[22] Filed: Feb. 3, 1997

[51] Int. Cl.[6] ..... F21V 17/00

[52] U.S. Cl. ..... 362/293; 362/17; 362/18; 362/298; 362/433

[58] Field of Search ..... 362/16–18, 293, 362/294, 298, 302, 303, 359, 11, 433, 449, 451, 455

[56] References Cited

U.S. PATENT DOCUMENTS

| | | | |
|---|---|---|---|
| 1,964,591 | 6/1934 | Nanfeldt | 362/18 |
| 2,076,240 | 4/1937 | Levy | 362/294 |
| 2,768,284 | 10/1956 | Woolley | 362/16 |
| 3,112,075 | 11/1963 | Sparks | 362/294 |
| 3,267,274 | 8/1966 | Johnson | 362/303 |
| 4,129,898 | 12/1978 | Ohrstedt | 362/18 |
| 4,504,888 | 3/1985 | Rosenthal | 362/18 |
| 4,707,773 | 11/1987 | Miyamoto | 362/303 |
| 5,203,627 | 4/1993 | Kira | 362/455 |
| 5,211,473 | 5/1993 | Gordin et al. | 362/359 |
| 5,371,663 | 12/1994 | Chuang | 362/455 |
| 5,602,605 | 2/1997 | Lierle | 362/18 |

*Primary Examiner*—Alan Cariaso
*Attorney, Agent, or Firm*—Lyon & Lyon LLP

[57] ABSTRACT

A lighting fixture for filming motion pictures includes a lamp housing having a rear bezel and a front three-sided frame. A rear reflector slidably attaches to the rear of the lamp housing over the bezel. A snoot has a rear bezel slidably fit into the three-sided front frame on the lamp housing. The snoot has a front frame similar or identical to the front frame on the lamp housing, so that a second snoot can be slidably attached onto the first snoot. The frames form slots for receiving and holding gels. The lighting fixture may used as a simple open front reflective lighting fixture, or the snoots or gels may be added to achieve various lighting conditions.

15 Claims, 3 Drawing Sheets

MOTION PICTURE LIGHTING FIXTURE

BACKGROUND OF THE INVENTION

The field of the invention is lighting for motion pictures.

Production of motion pictures requires various lighting conditions and effects. Motion picture filming may take place indoors or outdoors, with various natural or background lighting conditions. Under many conditions, additional lighting is required. Various lighting equipment has been made and used to meet these requirements, such as conventional motion picture or theatrical lighting fixtures, screens, reflectors, gels, etc. While existing lighting equipment has generally met the needs of the motion picture industry, the large amount of lighting equipment needed and used has several disadvantages. For example, when filming on location, all of the lighting equipment must be packed, transported, unpacked, and set up. Accordingly, the need for different pieces of lighting equipment may at times be met only with significant time and effort by lighting technicians. Significant costs may also be involved in the manufacture, storage, transportation, and use of a large number of pieces of lighting equipment. Accordingly, there remains a need in the motion picture industry to achieve lighting with fewer pieces of lighting equipment.

During motion picture filming, it may be necessary to quickly change the lighting conditions. Accordingly, there is a need for motion picture lighting fixtures which can be quickly and easily changed over to provide different lighting effects.

Accordingly, it is an object of the invention to provide an improved motion picture lighting fixture.

SUMMARY OF THE INVENTION

To these ends, a motion picture lighting fixture includes a lamp housing holding one or more lamps or bulbs. A reflector is preferably slidably attached onto the rear of the housing. A snoot is advantageously slidably attached to the front of the lamp housing. The snoot may have a black coated inside wall, to eliminate white reflected ghosts, or the snoot may have a white inside coated surface.

In a preferred embodiment, the lamp housing and snoot have a frame forming front and rear slots, with the front slot adapted to receive a snoot bezel, and the rear slot adapted to receive a gel frame.

The lighting fixture of the present invention offers a wide selection of lighting options with a minimum of equipment or accessories, from a simple open front reflective lamp to a controlled density of soft light, as well as several gel frame options. The gel frames and snoots can be quickly installed and removed via a slide mounting provided by the frame on the lamp housing and snoot.

BRIEF DESCRIPTION OF THE DRAWINGS

Other objects and features of the present invention will become apparent from the following detailed description taken in connection with the accompanying drawings which disclose several embodiments of the invention. It is to be understood, however, that the drawings are designed for the purpose of illustration only and are not intended as a definition of the limits of the invention.

In the drawings, wherein similar reference characters denote similar elements throughout the several views.

DETAILED DESCRIPTION OF THE DRAWINGS

Figure 1:
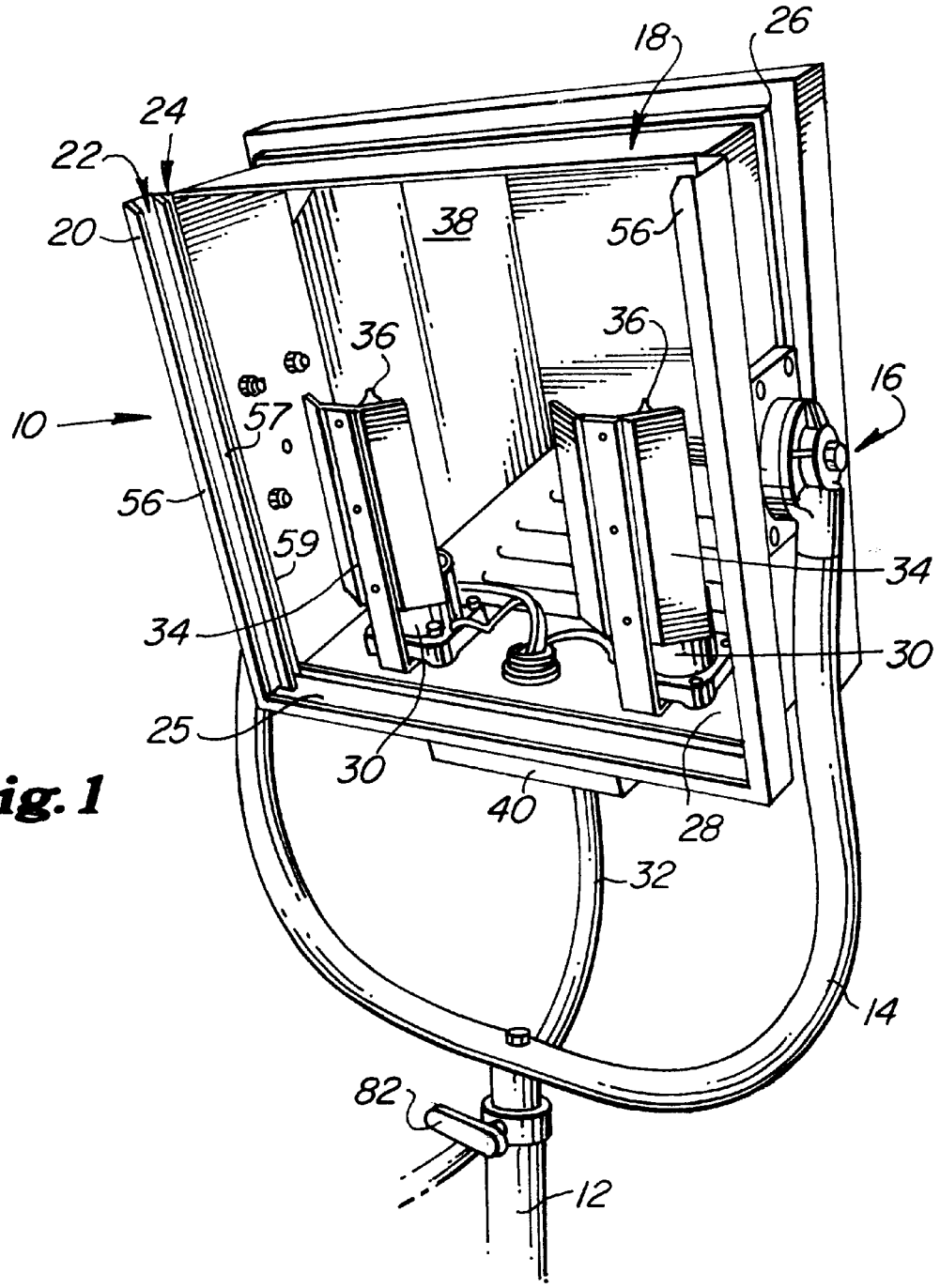
FIG. 1 is a perspective view of the present lighting fixture in its basic design as a simple open front reflective lighting fixture.

Turning now in detail to the drawings, as shown in FIG. 1, the present lighting fixture 10 includes a generally square lamp housing 18 having a three-sided front frame 20. The frame 20 has opposite sides and a bottom or floor 25, but no top. A front wall 56 on the frame 20 is spaced apart from a middle wall 57 to form a first slot 22, preferably about ½ inch wide. A rear wall 59 of the frame 20 is spaced apart from the middle wall 57 to form a second slot, preferably about ⅞ inch wide, behind the first slot 22.

Lamp sockets 30 holding lamps or bulbs 36 are mounted on a base plate 28 of the housing 18. A control box 40 under the base plate 28 includes switches for the bulbs 36 and a power connector (not shown). Globe or bulb reflectors 34 are mounted on the base plate 28 and positioned in front of the bulbs 36. The bulbs are preferably BWF 2000 watt, 120 volt.

The housing 18 is pivotably supported by pivot mounts 16 on a bracket 14 mounted on a lighting stand 12. Wiring 32 extends from the lamp sockets 30 to the control box 40 and then out to an electrical power source. A rear reflector 38 is attached to the back of the lamp housing 18.

Figure 2:
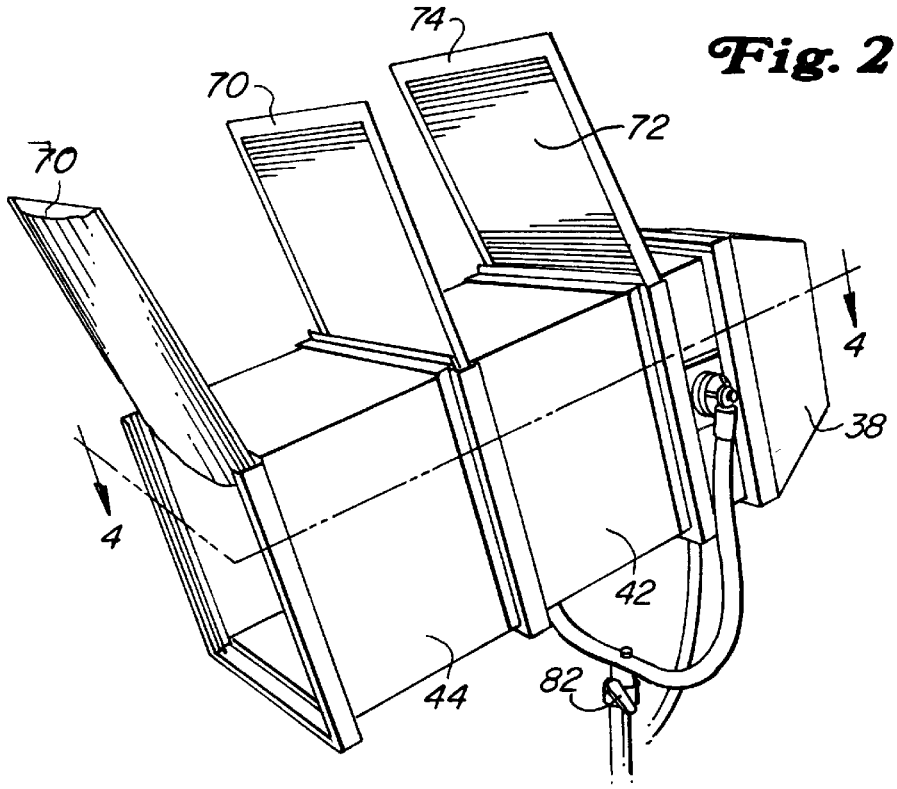
FIG. 2 is a perspective view of the lighting fixture of FIG. 1 with the addition of first and second snoots and gel frame.
Figure 3:
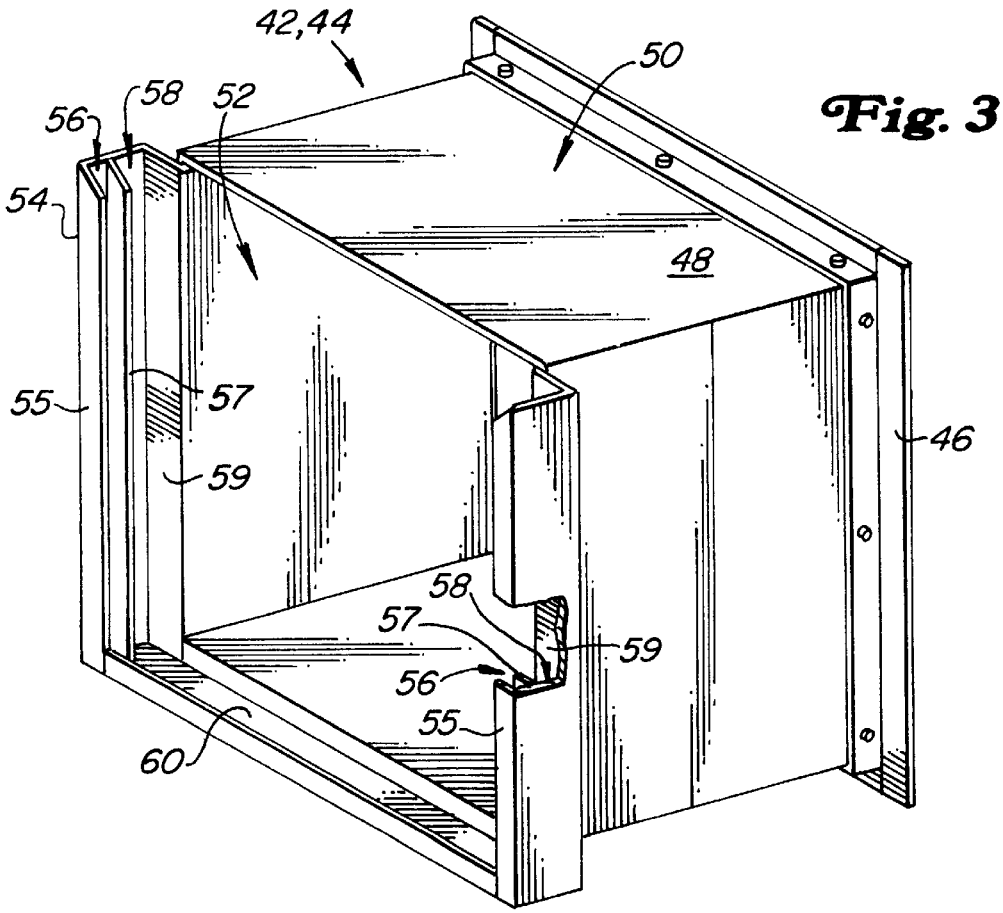
FIG. 3 is perspective view of a snoot of FIG. 2.

Turning to FIGS. 2 and 3, a first or black snoot 42 has black coated inside walls, to eliminate reflected ghosts. A second or white snoot 44, is preferably identical to the black snoot 42, except has white inside surfaces. The outside surface 50 of the snoot 42, 44 is black. Referring specifically to FIG. 3 (which illustrates both snoots) a bezel 46 is attached around the back perimeter of a generally square frame 48. The bezel 46 is dimensioned to slide into the first slot 22 on the lamp housing 18.

A three-sided frame 54 is attached to the front of the snoot body 48. The frame 54 has first and second slots 56 and 58, formed between walls 55, 57 and 59. The bottom of the frame 54 is closed off by a frame floor 60. The frame 54 is preferably identical in size and shape to the frame 20 on the lamp housing 18. Preferably, the lamp housing 18 and snoots 42, 44 are square, about 15 inches on each side and about 12 inches long. The lamp housing 18 is preferably about 3 inches deep or long.

Referring momentarily to FIG. 2, gel frames 70 include transparent, translucent, or colored gels 72 secured within a generally square metal frame 74.

Figure 4:
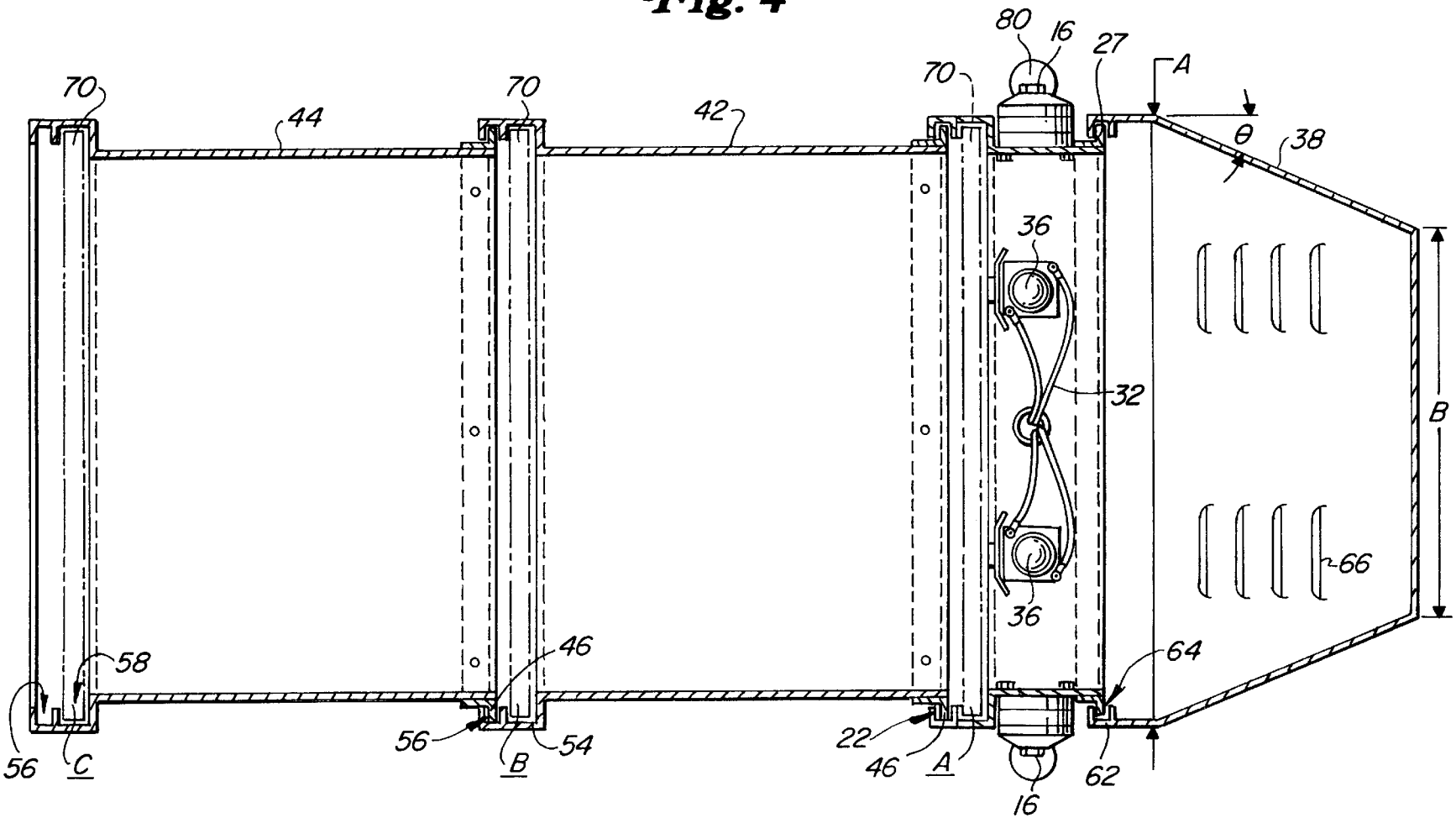
FIG. 4 is a section view taken along line 4—4 of FIG. 2.

Turning to FIG. 4, a rear bezel 27 is provided at the back surface of the lamp housing 18. The rear reflector 38 has a reflector frame 62 forming a slot 64 adapted to slide over the rear bezel 27 from above. The rear reflector 38 is provided with louvers or vents 66, on its top and bottom surfaces. The side walls of the rear reflector 38 advantageously taper inwardly at an angle θ of approximately 23°, from a dimension A of about 15⅝ inches, to a dimension B of about 9⅓ inches.

An elevation brake 80 is attached at one of the pivot joints 16, to lock the lamp housing 18 into position on the bracket 14, to maintain a fixed angle of elevation of the lighting fixture 10. An azimuth angle brake 82 may similarly be provided on the stand 12.

In use, the rear reflector 38 is attached to the lamp housing 18 by aligning the reflector frame 62 over the rear bezel 27 on the lamp housing 18. The rear reflector 38 is then lowered or dropped down until the top surface of the frame 62 comes to rest against the top edge of the bezel 27, with the rear reflector 38 then aligned on the lamp housing 18, as shown in the figures. This provides the embodiment shown in FIG. 1, suitable for use as a simple open front reflective lighting fixture. A gel frame 70 may be placed into the second or rear slot 24 on the front frame 20 of the lamp housing 18, by sliding or dropping the gel frame 70 in from above. The gel frame 70 is properly positioned when the bottom of the gel frame 70 comes to rest against the floor 25 of the frame 20.

Referring to FIGS. 2, 3 and 4, one or both snoots may be attached to the lamp housing 18. As shown in FIG. 4, the first snoot 44 is attached by aligning the bezel 46 at the rear of the snoot with the first or front slot 22 in the frame 20 on the lamp housing 18. The snoot 42 is moved down from above the frame 20, until the bottom of the bezel 46 comes to rest against the frame floor 25. A single snoot 42 or 44 may be used, with no gel frames; with a single gel frame on the lamp housing 18 (at position A in FIG. 4); with a single gel frame in the slot 58 at the front end of the snoot (at position B shown in FIG. 4); or with 2 gel frames in place (at positions A and B in FIG. 4).

The lighting fixture 10 may also be used with both snoots 42 and 44. Referring still to FIG. 4, the second snoot 44 is attached to the first snoot 42 in the same manner that the first snoot 42 is attached to the lamp housing 18. Specifically, the bezel 46 on the second snoot 44 is aligned over the front slot 56 formed in the frame 54 at the front end of the first snoot 42. The second snoot 44 is then lowered into position, until the bottom of bezel 46 contacts the frame floor 60. With this embodiment, as shown in FIGS. 2 and 4, one, two or three gel frames may be used at any of positions A, B and C shown in FIG. 4. In addition, either of the first snoot 42 and the second snoot 44 may have the black or white inside surfaces, to provide different lighting conditions.

The ability to use one or both of the snoots allows the lighting operator to provide a controlled density of soft light on the subject. The gels will also last longer because they can be positioned farther away from the bulbs and remain cooler.

Thus, a novel motion picture lighting fixture has been shown and described. Various modifications, substitutions, and uses of equivalents may be made, without departing from the spirit and scope of the invention. The invention, therefore, should not be limited, except by the appended claims.

I claim:

1. A lighting fixture comprising:

a lamp housing having a front frame including a first wall, a middle wall, and a rear wall, with the front wall and middle wall forming a first slot, and with the middle wall and rear wall forming a second slot, the first slot adapted to receive a snoot bezel, and the second slot adapted to receive a gel frame;

a rear reflector attached to the lamp housing;

a bulb reflector within the lamp housing spaced apart from the rear reflector;

a bulb positioned between the rear reflector and the bulb reflector;

a gel within a gel frame positioned in the second slot; and a snoot slidably attached to the lamp housing.

2. A lighting fixture comprising:

a lamp housing;

a rear bezel on the lamp housing, and a rear reflector having a reflector frame slidably attached over the bezel on the lamp housing;

a bulb reflector within the lamp housing spaced apart from the rear reflector;

a bulb positioned between the rear reflector and the bulb reflector; and a snoot attached to the lamp housing.

3. The lighting fixture of claim 2 wherein the snoot has a black inside wall.

4. The lighting fixture of claim 2 wherein the snoot has a white inside wall.

5. The lighting fixture of claim 2 wherein the snoot has a front end and a back end, with the front end of the snoot including a snoot frame having a front wall, a middle wall, and a rear wall, with the front and middle wall forming a first slot adapted to receive a snoot bezel, and with the middle wall and rear wall forming a second slot adapted to receive a gel frame.

6. The lighting fixture of claim 2 further comprising a second snoot slidably attached to the snoot attached to the front of the housing.

7. A lighting fixture for motion picture filming, comprising:

at least one lamp in a lamp housing a lamp reflector in front of the bulb;

a rear reflector having a three-sided reflector frame slidably attached over a bezel at the rear of the lamp housing;

a front three-sided frame on the front of the lamp housing, the front frame having a front wall, a middle wall, and a rear wall, with the front wall and middle wall spaced apart to form a first slot, and with the middle wall and rear wall spaced apart to form a second slot; and a snoot having a bezel at its back end, with the bezel slidably engaged into the first slot of the front frame on the lamp housing.

8. The lighting fixture of claim 7 further comprising a gel frame slidably positioned within the second slot of the front frame on the lamp housing.

9. The lighting fixture of claim 7 wherein the snoot further comprises a three-sided frame at its front end, the frame including a first wall, a middle wall, and a rear wall with the first wall forming a third slot, and with the middle wall and rear wall forming a fourth slot.

10. The lighting fixture of claim 9 further comprising a second snoot having a rear bezel slidably attached within the third slot.

11. The lighting fixture of claim 9 further comprising a second gel frame slidably positioned in the fourth slot.

12. The lighting fixture of claim 9 wherein the first snoot is substantially identical to the second snoot.

13. A lighting fixture comprising:

a lamp housing;

a reflector attached near the back of the lamp housing;

a snoot slidably attached near the front of the lamp housing;

the snoot having a front and a back end, with a snoot frame near the front end;

the snoot frame having front, middle and rear walls, with the front and middle walls forming a first slot adapted to receive a snoot bezel, and with the middle and rear wall forming a second slot adapted to receive a gel frame.

14. A lighting fixture comprising:

a lamp housing having a front frame including first, middle, and rear walls, with the front and middle walls forming a first slot, and with the middle and rear walls forming a second slot;

a reflector within the lamp housing; and a snoot supported on one of the first and second slots.

15. The lighting fixture of claim 14 wherein the snoot is in the first slot, further comprising a gel frame in the second slot.

* * * * *